US008256551B2

(12) United States Patent
Entriken et al.

(10) Patent No.: US 8,256,551 B2
(45) Date of Patent: Sep. 4, 2012

(54) AGRICULTURAL VEHICLE COOLING ASSEMBLY FAN SHROUD WITH SEALS FOR PASS-THROUGH COOLING AND EXHAUST TUBES

(75) Inventors: Shawn M. Entriken, Jackson, MN (US); Joshua A. Peterson, Jackson, MN (US)

(73) Assignee: AGCO Corporation, Duluth, GA (US)

( * ) Notice: Subject to any disclaimer, the term of this patent is extended or adjusted under 35 U.S.C. 154(b) by 435 days.

(21) Appl. No.: 12/650,274

(22) Filed: Dec. 30, 2009

(65) Prior Publication Data

US 2011/0155081 A1 Jun. 30, 2011

(51) Int. Cl.

| | |
|---|---|
| ***B60K 11/00*** | (2006.01) |
| ***B60K 13/02*** | (2006.01) |
| ***B60K 11/04*** | (2006.01) |
| ***F01P 7/10*** | (2006.01) |
| ***F03B 1/00*** | (2006.01) |
| ***F24H 3/06*** | (2006.01) |

(52) U.S. Cl. ..... 180/68.1; 180/68.2; 180/68.4; 180/68.3; 123/41.49; 415/208.1; 165/122

(58) Field of Classification Search ..... 180/68.1, 180/68.2, 68.3, 68.4; 123/41.49; 415/208.1; 165/122, 124

See application file for complete search history.

(56) References Cited

U.S. PATENT DOCUMENTS

| | | | | |
|---|---|---|---|---|
| 2,708,920 | A * | 5/1955 | Pasturczak | 180/68.3 |
| 3,786,891 | A * | 1/1974 | Vogelaar et al. | 180/68.4 |
| 3,937,189 | A * | 2/1976 | Beck | 123/41.49 |
| 4,018,297 | A | 4/1977 | Haupt | |
| 4,086,976 | A * | 5/1978 | Holm et al. | 180/68.1 |
| 4,454,926 | A * | 6/1984 | Akins | 180/68.1 |
| 4,522,160 | A * | 6/1985 | Speers et al. | 123/41.49 |
| 4,656,975 | A * | 4/1987 | Johnson | 123/41.68 |
| 5,427,502 | A | 6/1995 | Hudson | |
| 5,709,175 | A * | 1/1998 | Carroll | 123/41.49 |
| 6,202,777 | B1 * | 3/2001 | Surridge | 180/68.1 |
| 6,216,778 | B1 * | 4/2001 | Corwin et al. | 123/41.49 |
| 6,907,854 | B2 | 6/2005 | Wikner | |
| 6,976,825 | B2 | 12/2005 | Wikner | |
| 7,128,178 | B1 | 10/2006 | Heinke et al. | |
| 7,278,504 | B2 | 10/2007 | Smith et al. | |
| 7,481,287 | B2 * | 1/2009 | Madson et al. | 180/68.1 |
| 7,946,368 | B2 * | 5/2011 | Vandike et al. | 180/68.1 |
| 2011/0011665 | A1 | 1/2011 | Peterson et al. | |
| 2011/0272202 | A1 * | 11/2011 | Kawashiri et al. | 180/69.21 |

* cited by examiner

*Primary Examiner* — J. Allen Shriver, II
*Assistant Examiner* — James M Dolak

(57) ABSTRACT

A self-propelled, low-emission vehicle includes an internal combustion engine, a vehicle cooling assembly, and an engine exhaust assembly disposed within an engine compartment. The vehicle cooling assembly includes an enclosure and a powered fan to vent the enclosure by drawing a stream of cooling air therethrough. The engine exhaust assembly carries exhaust gas through exhaust lines from the engine, which is disposed outside of the enclosure, through an exhaust treatment device, which is disposed inside of the enclosure, and out to the environment. A fan shroud assembly defines an outlet margin of the enclosure and includes a shroud body defining a pair of passageways through which the exhaust lines pass. The fan shroud assembly includes an insulated connection assembly disposed adjacent each passageway to provide sealing connection between the respective exhaust line and the shroud body while prohibiting direct contact between the respective exhaust line and the shroud body.

22 Claims, 9 Drawing Sheets

AGRICULTURAL VEHICLE COOLING ASSEMBLY FAN SHROUD WITH SEALS FOR PASS-THROUGH COOLING AND EXHAUST TUBES

BACKGROUND OF THE INVENTION

1. Field of the Invention

The present invention relates generally to agricultural vehicles. More specifically, the present invention concerns a fan shroud assembly that defines a margin of an enclosure for a vehicle cooling assembly and provides a passageway therethrough to receive an exhaust line extending into and out of the enclosure.

2. Discussion of the Prior Art

Those of ordinary skill in the art will appreciate that many agricultural vehicles, such as a self-propelled vehicle (e.g., a tractor), often include a diesel engine that produces exhaust. Such vehicles are subject to federal emissions regulations promulgated by the Environmental Protection Agency (EPA). As is often the case, the relevant regulations are occasionally revised over time, typically requiring that newer vehicles conform to more stringent standards, such as emitting reduced levels of emissions into the environment.

Conventionally, one method of reducing the levels of emissions emitted into the environment involves treating exhaust gases produced by the engine with an exhaust aftertreatment device (EAD). Such a device, often including a diesel particulate filter (DPF) and/or a selective catalytic reduction (SCR) device, are generally known in the art to be capable of sufficiently reducing diesel exhaust emissions to comply with newer EPA emission standards for off-road vehicles.

The use of exhaust treatment devices often requires the use of various hoses, tubes, etc., to supply necessary fluids to the devices. In addition, the flow of exhaust gases must be introduced into the device and discharged therefrom, often through exhaust lines that operate at high temperatures. General purpose fan shrouds are also known in the art and are often mounted at an outlet of a fan enclosure to draw a stream of cooling air through an arrangement of one or more heat exchangers to cool various engine components.

Traditionally, any required hoses, tubes, exhaust lines, and the like, have been routed around any shroud body such that efficient airflow is maintained and possible recirculation into the enclosure is reduced. In addition, the materials often used to construct general purpose fan shrouds cannot withstand the high temperatures of the exhaust lines leading to and from an exhaust treatment device. This has led to complex routing arrangements of hoses, tubes, exhaust lines, and the like, which typically requires additional space for efficient operation. Those of ordinary skill in the art will also appreciate that space within an engine compartment designed to be covered with a hood is often at a premium.

SUMMARY

According to an aspect of the present invention, an agricultural vehicle cooling assembly fan shroud with seals for pass-through cooling and exhaust tubes is provided that reduces the installation space required of the system to more readily fit within an engine compartment. A fan shroud body includes an exhaust line receiving passageway extending therethrough so that an exhaust line is passed through the body of the shroud, allowing for a smaller overall assembly. The fan shroud assembly also includes insulated connection assemblies disposed adjacent the passageway to sealingly connect the exhaust line to the shroud body while prohibiting direct contact between the exhaust line and the shroud body. The inventive construction of this assembly further provides ready access to components for maintenance purposes, and allows parts to move relative to one another while still functioning efficiently. The sealing connection around the exhaust line receiving passageway prevents undesired recirculation of hot air back into the cooling assembly enclosure.

According to one aspect of the present invention, a fan shroud assembly is provided for use with a cooling assembly of an engine-powered vehicle, where the vehicle has a high-temperature engine exhaust line presenting an outer dimension. The fan shroud assembly includes a shroud body with a radially inner converging portion and a radially outer base portion. The converging portion protrudes axially and presents a radially inner margin that defines a generally axially oriented central opening configured to be disposed adjacent a fan. The base portion defines a generally axially oriented exhaust line receiving passageway spaced radially from the central opening and configured to receive the exhaust line therethrough. The exhaust line receiving passageway is configured so as to present an inner dimension that is greater than the outer dimension of the exhaust line, thereby presenting an air gap between the shroud body and the exhaust line prohibiting direct contact therebetween. The fan shroud assembly further includes an insulated connection assembly disposed adjacent the exhaust line receiving passageway and configured to provide a sealing connection between the exhaust line and the shroud body. The connection assembly presents an elongated body configured to span the air gap and sealingly engage the shroud body and the exhaust line adjacent opposite ends thereof.

According to another aspect of the present invention, a self-propelled, low-emission vehicle is provided that has an engine compartment in which an internal combustion engine operable to power the vehicle is disposed. The vehicle includes a vehicle cooling assembly disposed within the engine compartment with an enclosure and a powered fan operable to vent the enclosure, with the engine being disposed outside of the enclosure. The enclosure presents an air inlet and an air outlet to define an airflow area extending therebetween and including at least one heat exchanger operable to discharge heat produced by the vehicle. The powered fan is rotatable about an axis, disposed along one of the air inlet or the air outlet, and operable to direct a stream of air along a path between the air inlet and the air outlet. The vehicle also includes an engine exhaust assembly operable to carry engine exhaust gas away from the engine and out to the environment. The engine exhaust assembly includes an exhaust treatment device disposed within the enclosure and at least partly within the airflow area to remove heat therefrom. The engine exhaust assembly includes intake and discharge exhaust lines leading to and from the exhaust treatment device, respectively. The vehicle further includes a fan shroud assembly that defines a margin of the enclosure and includes a shroud body that presents a radially inner converging portion and a radially outer base portion. The converging portion protrudes axially and presents a radially inner margin that defines a generally central opening disposed adjacent the fan. The base portion defines a pair of generally axially oriented passageways spaced radially from the central opening. Each of the passageways receives a respective one of the exhaust lines therethrough and is oversized relative to the respective exhaust line so as to present an air gap between the shroud body and the respective exhaust line to prohibit direct contact therebetween. The fan shroud assembly includes an insulated connection assembly disposed adjacent each passageway to provide sealing connection between the respective exhaust line and the shroud body.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figure 2:
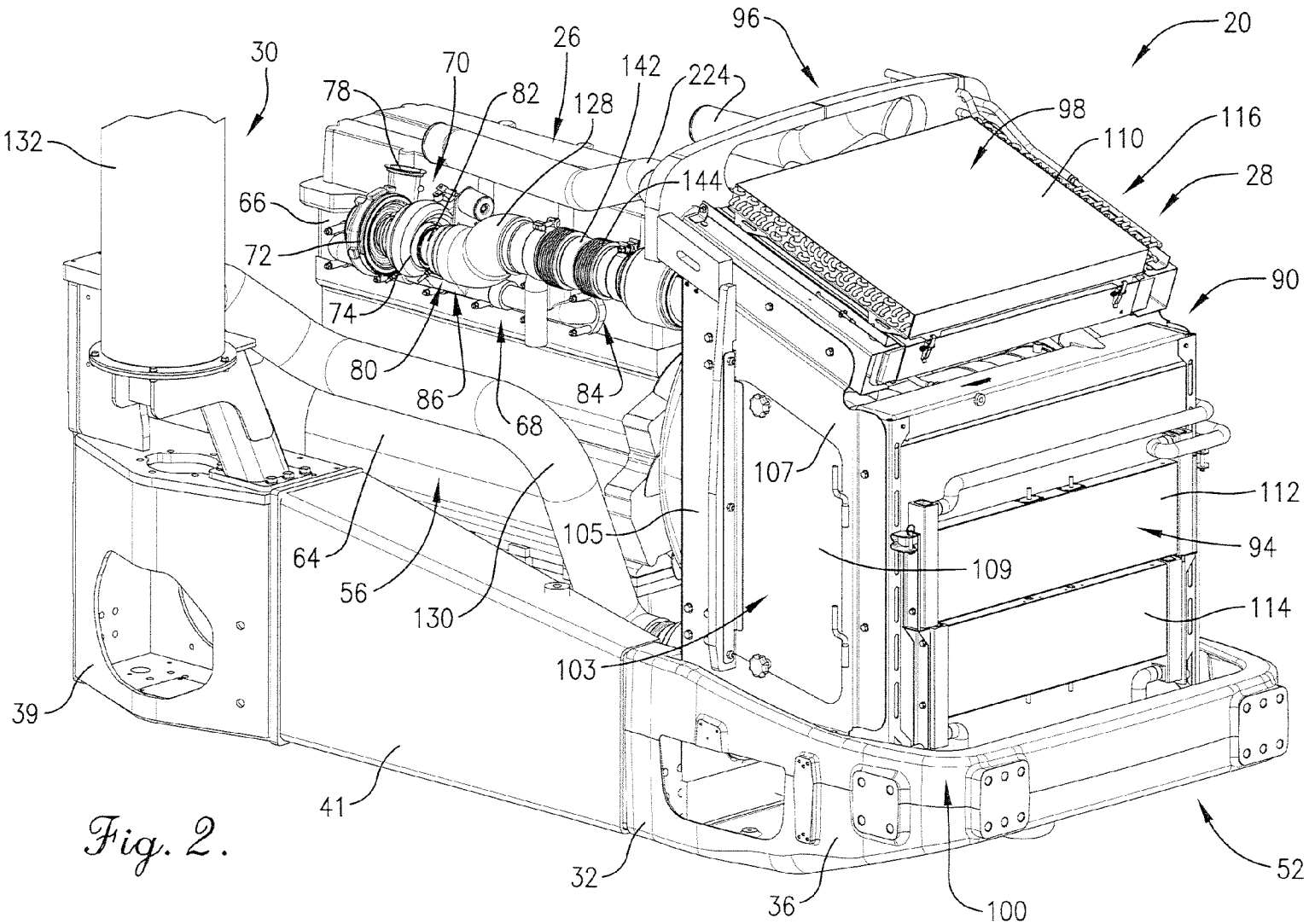
FIG. 2 is an enlarged, fragmentary, generally right front isometric view of a front-end assembly of the tractor of FIG. 1, depicting a portion of the frame, the diesel engine assembly, the vehicle cooling assembly, and the engine exhaust assembly, with the diesel engine assembly, the vehicle cooling assembly, and the engine exhaust assembly all mounted on the frame.
Figure 3:
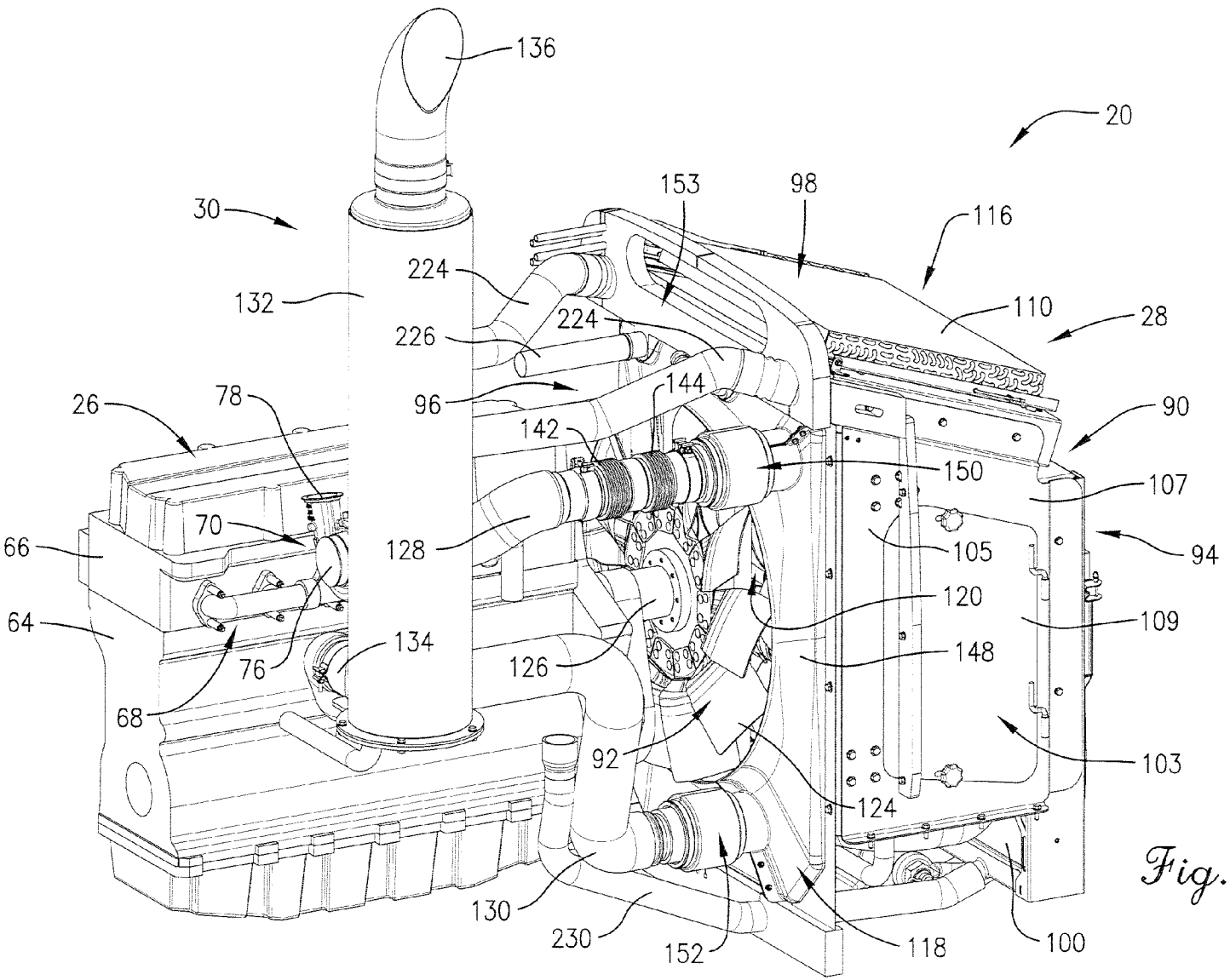
FIG. 3 is an enlarged, fragmentary, generally right rear isometric view of the front-end assembly of FIG. 2, depicting components of the cooling assembly, including a fan and a fan shroud assembly, and components of the exhaust assembly, including exhaust lines and fluid tubes, with the exhaust lines and fluid tubes passing through the fan shroud assembly.
Figure 4:
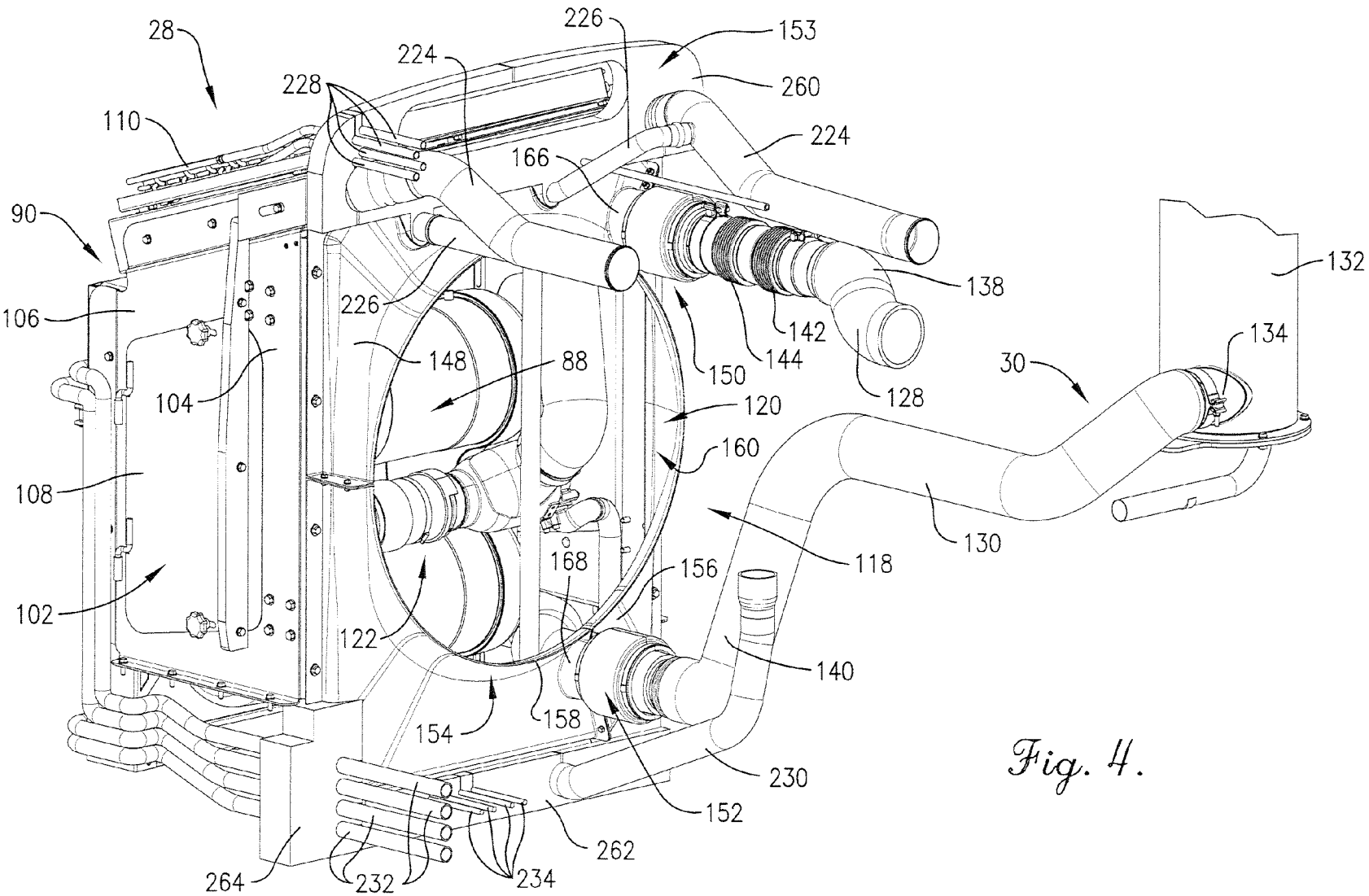
Figure 5:
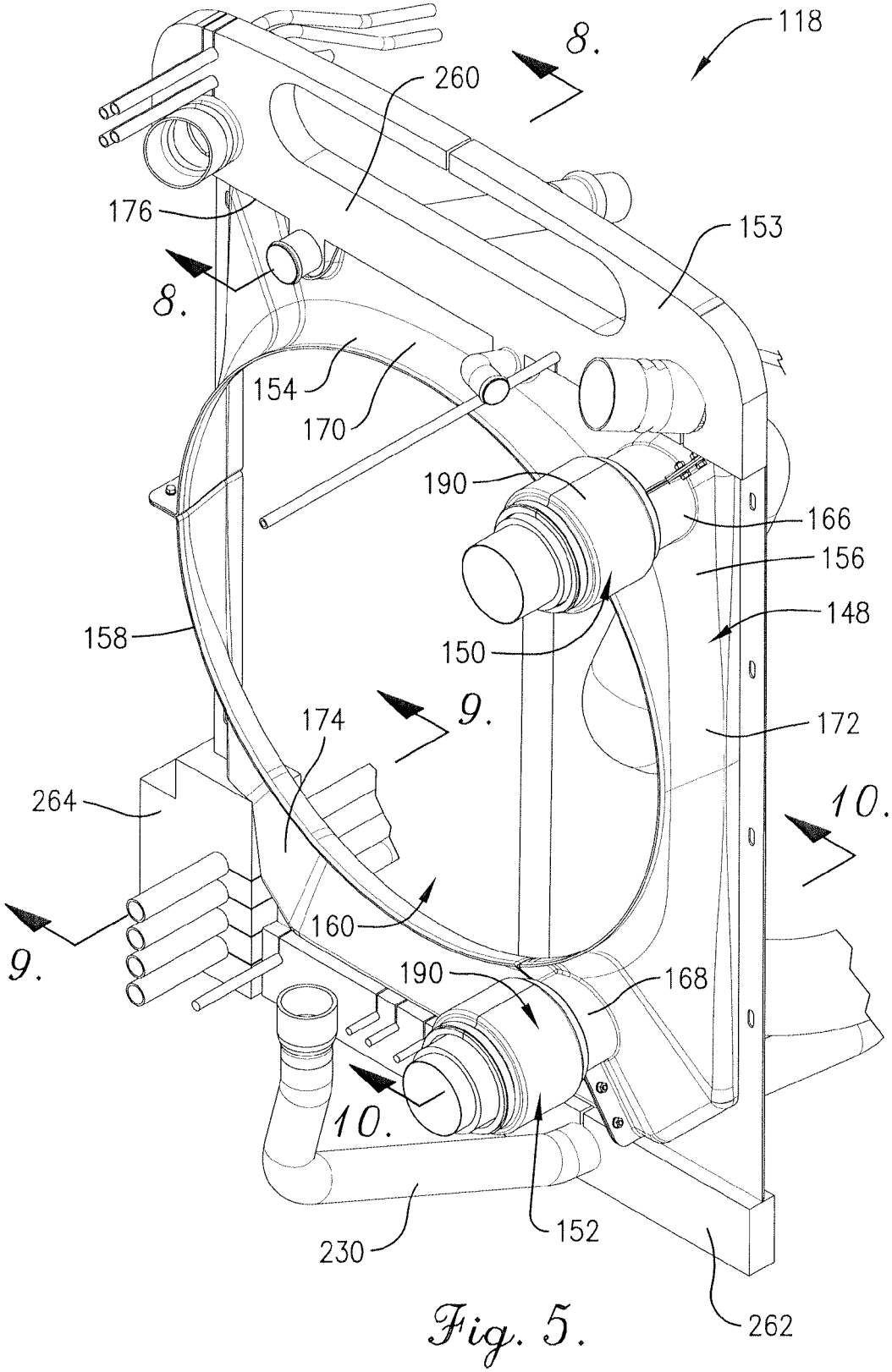
Figure 6:
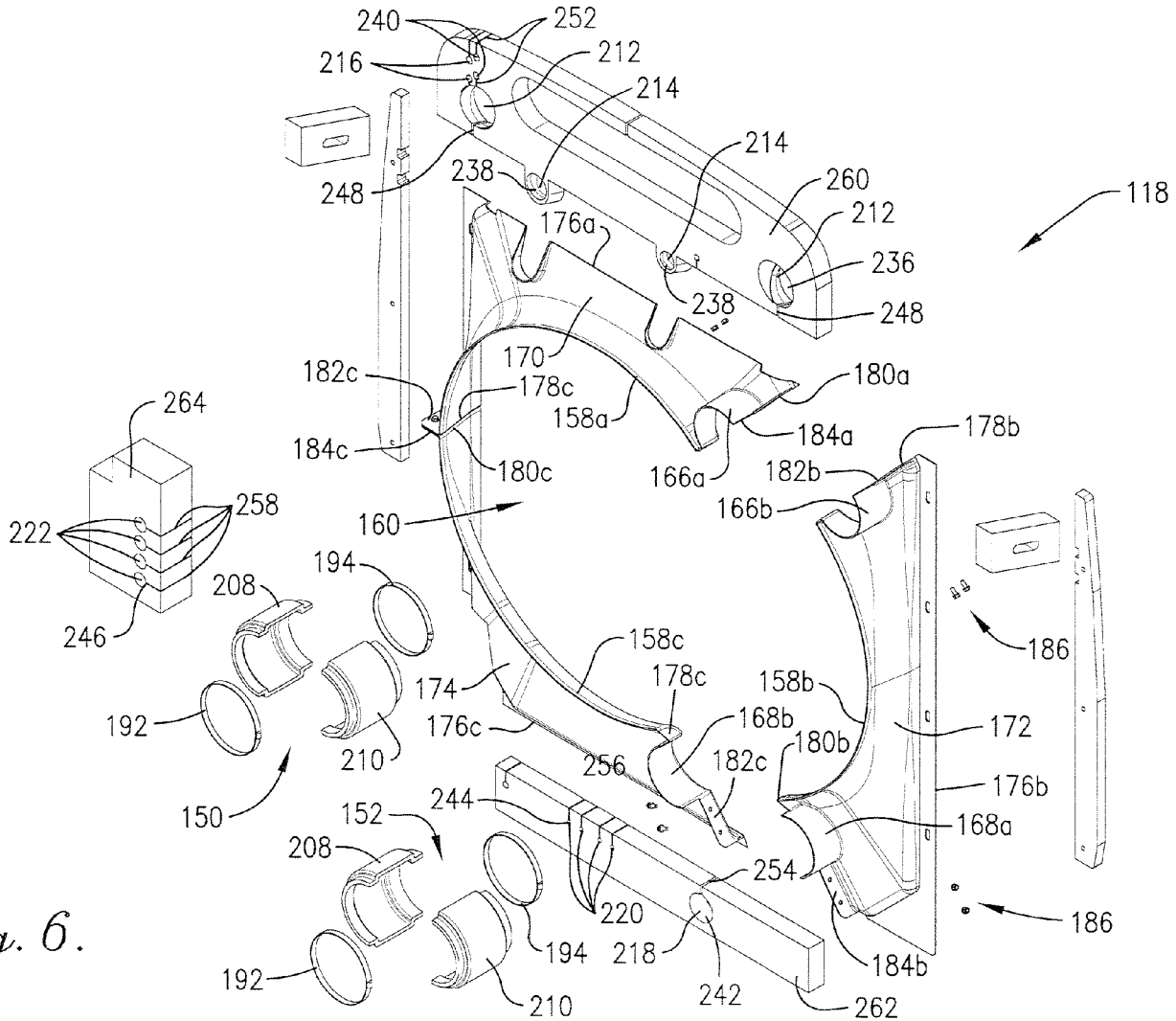
Figure 7:
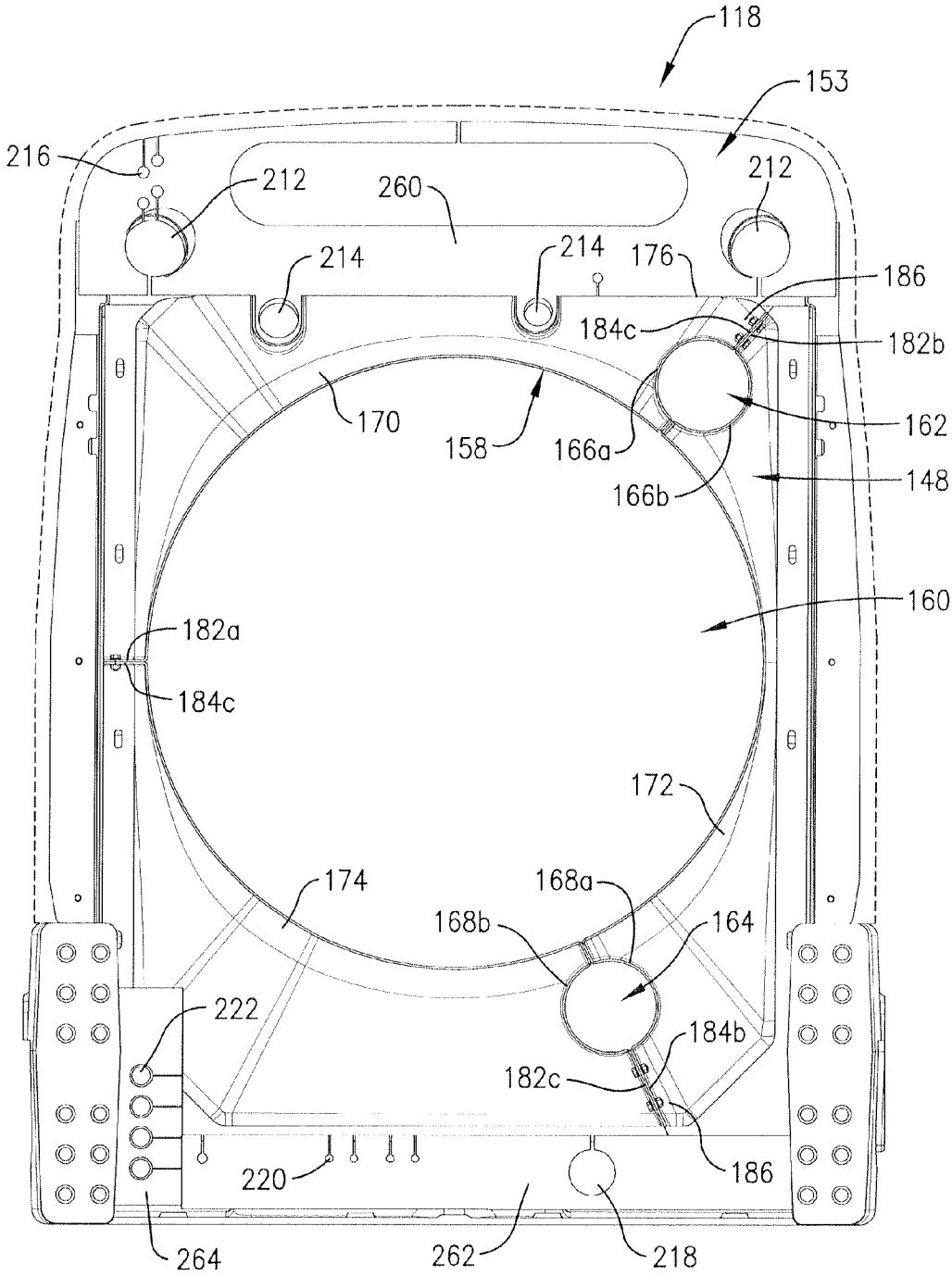
Figure 9:
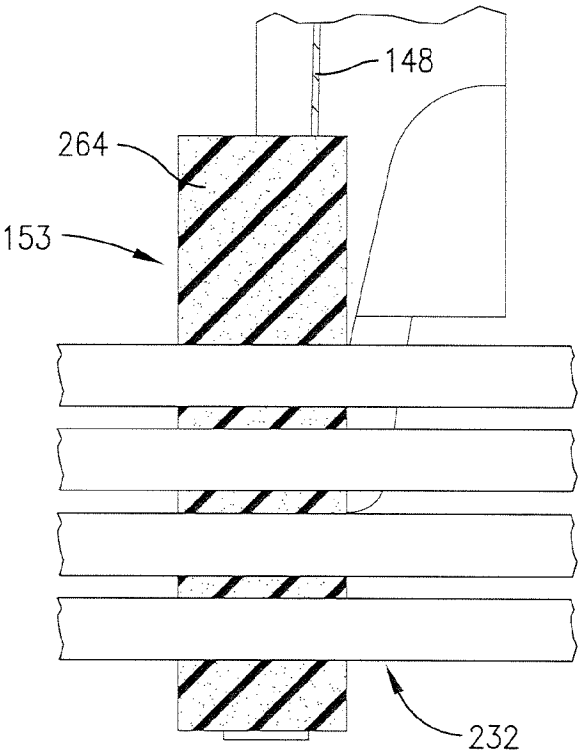
Figure 8:
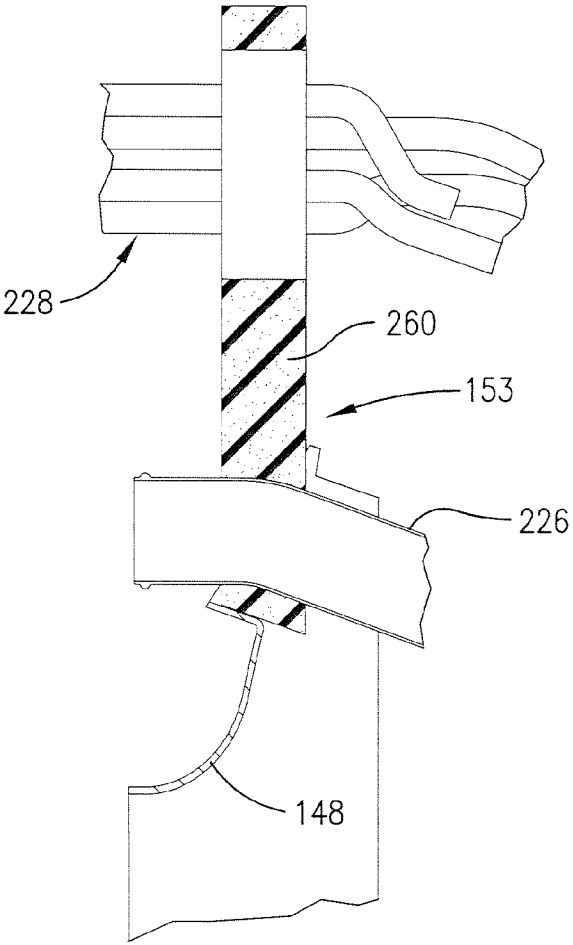
Figure 10:
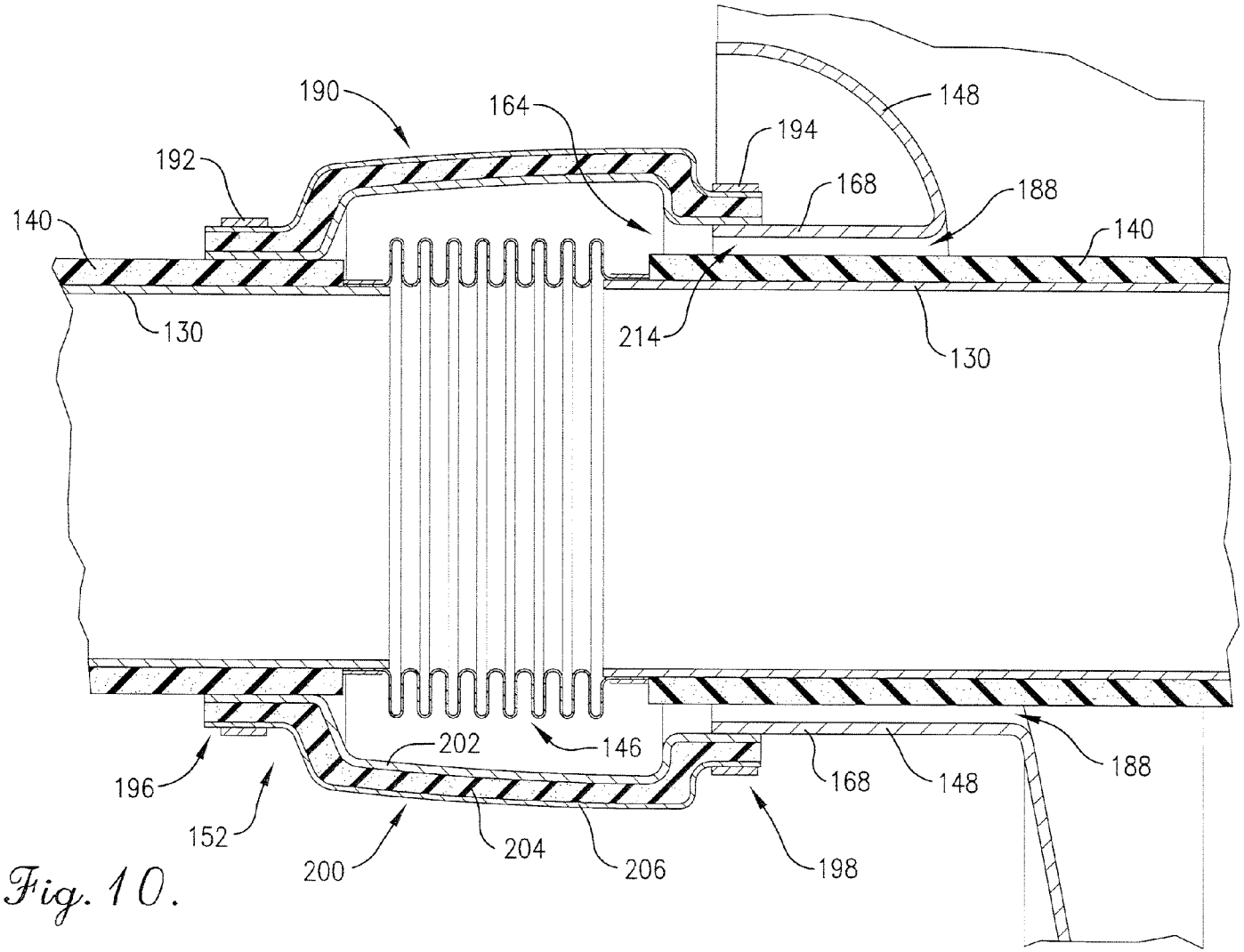

FIG. 4 is an enlarged, fragmentary, generally left rear isometric view of the front-end assembly of FIGS. 2-3, shown with some components, such as the engine and the fan, removed to illustrate additional details of an enclosure of the cooling assembly, depicting a portion of an exhaust treatment device disposed within the enclosure and the fan shroud assembly, with the exhaust lines and fluid tubes passing therethrough, defining an outlet margin of the enclosure;

FIG. 5 is an enlarged, fragmentary, isometric view of the fan shroud assembly of FIGS. 3-4, depicting in detail a shroud body, a plurality of insulated connection assemblies disposed about the exhaust lines passing through the shroud body, and a plurality of sealing element portions disposed about the periphery of the shroud body, with fluid tubes passing through the sealing element portions;

FIG. 6 is an enlarged, exploded, fragmentary, isometric view of the fan shroud assembly of FIG. 5, shown with the exhaust lines and the fluid tubes removed to illustrate additional structural details of the fan shroud assembly, depicting sections of a sectioned shroud body, individual sealing element portions, and components of the insulated connection assemblies;

FIG. 7 is an enlarged, fragmentary, rear elevation view of the fan shroud assembly of FIGS. 5-6, shown with the exhaust lines, the fluid tubes, and the insulated connection assemblies removed to illustrate additional structural details of the fan shroud assembly, depicting the sections of the sectioned shroud body fastened to one another with the sealing element portions disposed about the periphery of the shroud body;

FIG. 8 is an enlarged, fragmentary, side elevation view of a portion of the fan shroud assembly of FIGS. 5-7, taken along the line 8-8 of FIG. 5, depicting in detail one of the fluid tubes along an upper area of the fan shroud assembly extending through a passage in one of the sealing element portions;

FIG. 9 is an enlarged, fragmentary, side elevation view of a portion of the fan shroud assembly of FIGS. 5-7, taken along the line 9-9 of FIG. 5, depicting in detail a group of the fluid tubes along a lower area of the fan shroud assembly extending through respective passages in another of the sealing element portions; and FIG. 10 is an enlarged, fragmentary, side elevation view of a portion of the fan shroud assembly of FIGS. 5-7, taken along the line 10-10 of FIG. 5, depicting in detail one of the exhaust lines extending through a passageway of the shroud body with one of the insulated connection assemblies securing the exhaust line to a rim of the shroud body around the passageway.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1:
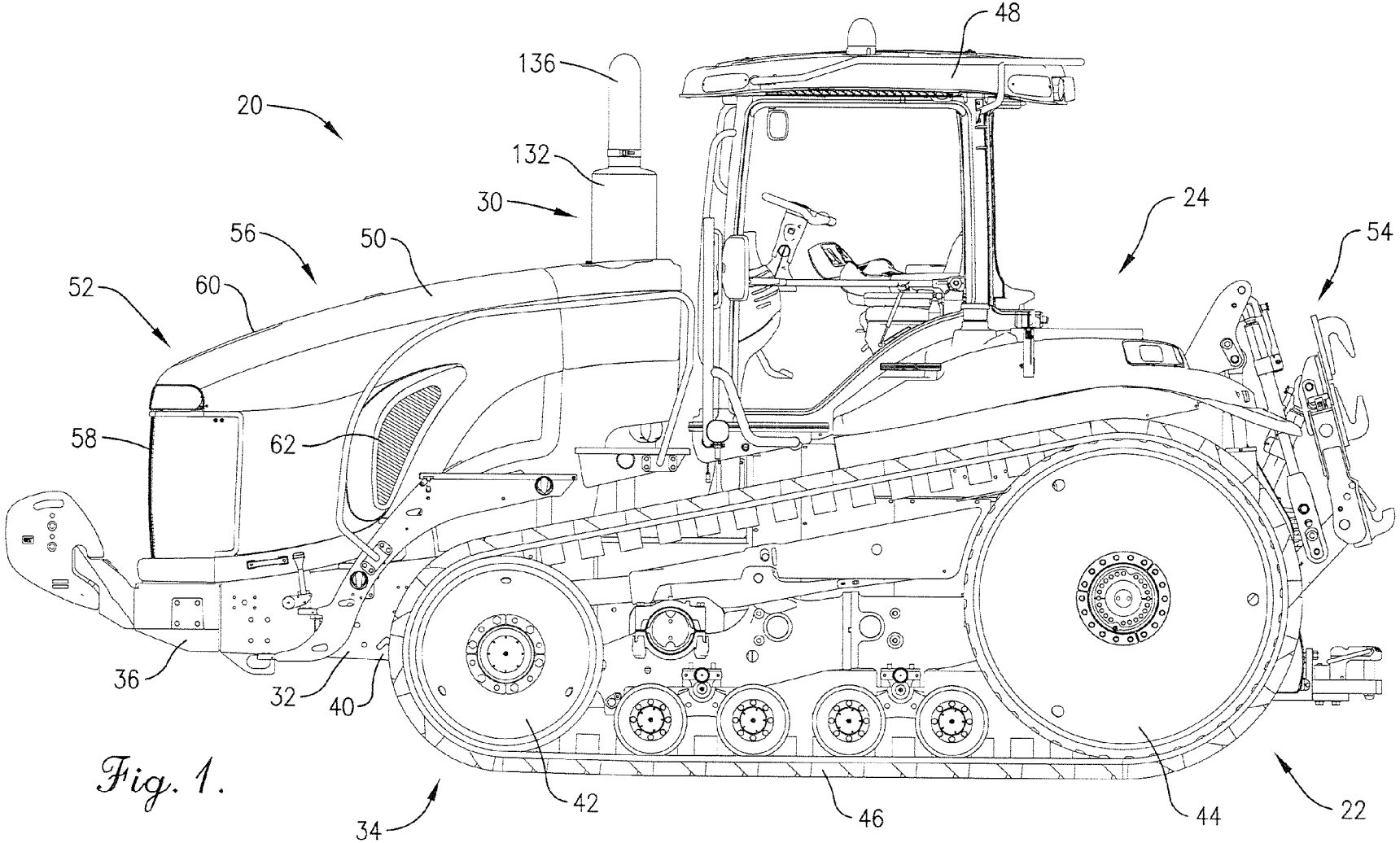
FIG. 1 is a left side elevation view of an agricultural off-road tractor constructed in accordance with the principles of a preferred embodiment of the present invention, with the illustrated tractor generally depicting a rolling chassis, a frame, a diesel engine assembly, a vehicle cooling assembly, and an engine exhaust assembly.

With initial reference to FIGS. 1-3, a diesel-powered agricultural tractor 20 is designed to operate under federal emissions standards. In particular, the Environmental Protection Agency (EPA) has promulgated stringent standards that require substantial reductions in the acceptable emission amounts of mono-nitrogen oxides ($NO_X$) and particulate matter for off-road vehicles. Newly manufactured off-road vehicles, such as the illustrated tractor 20, are now required to use emission control technologies (e.g., diesel oxidation catalysts (DOCs), particulate filters, and $NO_X$ absorbers), in order to meet the EPA requirements. In addition, the EPA standards require reduction of sulfur content in non-road diesel fuels to enable the use of the emission control technologies.

The illustrated tractor 20 broadly includes a rolling chassis 22, a main body 24, a diesel engine 26, a vehicle cooling assembly 28, and an engine exhaust assembly 30. It is noted that while the illustrated tractor 20 is designed to meet the stringent EPA emissions requirements, the principles of the present invention are also applicable to other off-road vehicles, such as other agricultural or utility vehicles. It is also noted that the illustrated tractor 20 need not meet the stringent EPA emissions requirements in order to practice the principles of the present invention. For example, the broad concepts of the present invention are equally applicable to vehicles that meet other emissions standards or no standards at all.

The rolling chassis 22 is constructed to support the remainder of the tractor 20. The rolling chassis 22 broadly includes a longitudinal chassis frame 32 and a pair of track assemblies 34, 35. In a conventional manner, the chassis frame 32 extends generally longitudinally along a vehicle axis, is substantially rigid, and is constructed to resist various forces (e.g., pulling forces, pushing forces, and torsional forces) due to normal use of the tractor 20. The chassis frame 32 includes a forward pan 36, intermediately-spaced towers 38, 39, and frame rails 40, 41 that extend from respective towers 38, 39 forwardly to the pan 36. As will be discussed in greater detail, the chassis frame 32 is configured to support the diesel engine 26 as well as the vehicle cooling assembly 28 and the engine exhaust assembly 30.

The chassis frame 32 also presents outermost sides as well as front and rear frame ends, with the engine 26, the cooling assembly 28, and the exhaust assembly 30 being generally spaced between the frame sides and between the front and rear ends of the frame, as will be readily appreciated by one of ordinary skill in the art upon review of this disclosure. The illustrated chassis frame 32 is constructed of conventional carbon steel. However, the principles of the present invention are also applicable to an alternative chassis frame (not shown) that may be constructed of other materials or may be otherwise shaped or constructed to support the engine 26, the cooling assembly 28, and the exhaust assembly 30.

Each track assembly 34, 35 is operably attached to the chassis frame 32 along respective left and right sides of the chassis frame 32. Each track assembly 34, 35 is generally conventional and is drivingly powered by the diesel engine 26. The illustrated track assembly 34 broadly includes front and rear track wheels 42, 44 and an endless track belt 46 that extends around the corresponding track wheels 42, 44. The rear track wheel 44 is drivingly attached to the diesel engine 26 by a transmission (not shown). The opposite track assembly 35 is generally similar in construction. Thus, the track assemblies 34, 35 and the chassis frame 32 cooperate to provide a rolling platform for the tractor 20. It is noted, however, that the principles of the present invention are equally applicable when the rolling chassis 22 is alternatively constructed. For example, the tractor 20 could be supported on each side of the chassis frame 32 by individual front and rear ground-engaging wheels (not shown) instead of the track assemblies 34, 35 without departing from the teachings of the present invention.

With continued reference to FIGS. 1-3, it will be readily appreciated that the body 24 is mounted on the rolling chassis 22 and broadly includes a cab 48 and a hood 50. The chassis 22 and the body 24 cooperatively present front and rear ends 52, 54 of the tractor 20 and extend longitudinally between the ends 52, 54 along the vehicle axis. The cab 48 is generally conventional and is mounted between the ends 52, 54. In the usual manner, the cab 48 includes various vehicle controls and serves to house the operator of the tractor 20. The cab 48 is also positioned above the chassis 22 (more particularly, above the track assemblies 34, 35) to provide a clear line of sight to locations around the tractor 20.

The hood 50 is removably mounted to the chassis frame 32 and extends forwardly of the cab 48 to the front end 52 of the tractor 20. The body 24 and the chassis frame 32 cooperatively define an engine compartment 56 that is disposed underneath the hood 50 (when the hood 50 is installed on the tractor 20 in a conventional manner). As will be readily appreciated by one of ordinary skill in the art, the engine compartment 56 is configured to receive the diesel engine 26. The illustrated hood 50 and the engine compartment 56 are spaced forwardly along the tractor 20 and adjacent the front end 52. It is noted, however, that it is also within the scope of the present invention to position the hood 50 and the engine compartment 56 at a different location along the length of the tractor 20. For example, the hood 50 or the engine compartment 56 could be alternatively located rearwardly along the tractor 20 adjacent the rear end 54 (e.g., for a rear-engine, off-road vehicle, such as a front loader).

The hood 50 is generally elongated and presents a front vent 58, a top vent 60 adjacent the front vent 58, and side vents 62 positioned along respective sides of the hood 50. In the usual manner, the vents 58, 60, 62 comprise perforated sections of the hood 50 and permit air to flow therethrough. In particular, the vents 58, 60, 62 permit fluid communication between the engine compartment 56 and the outside environmental air. Furthermore, the forward pan 36 presents a lower vent (not shown) spaced adjacent the front end 52. In use, fresh air enters the engine compartment 56 through the front vent 58, the top vent 60, and the lower vent (not shown), and heated air exits the engine compartment 56 in a rearward direction from the rear of the hood 50 and from the sides through the side vents 62.

As with many off-road vehicles, it is also possible for the hood 50 to provide open side margins so that the engine 26 is generally exposed to the environmental air along the sides thereof. While the illustrated configuration of vents is preferable, it is also within the scope of the present invention to include an alternative placement of vents used with the hood 50. For example, if the lid 50 is mounted adjacent the rear end of an alternative vehicle to thereby comprise a rear-mounted hood, corresponding vents may be alternatively configured to provide airflow into and out of the engine compartment 56 (e.g., by positioning vents along the sides and rear of the hood 50).

Turning now to FIGS. 2-3, the diesel engine 26 comprises a generally conventional six-cylinder engine that is operable to power the tractor 20. In particular, the illustrated engine 26 powers the track assemblies 34, 35 and provides power associated with various hydraulic and electronic controls (not shown). The diesel engine 26 broadly includes an engine block 64, a cylinder head 66, cylinders (not shown), an intake manifold (not shown), an exhaust manifold 68, and a turbocharger 70. The turbocharger 70 is also conventional and includes a compressor 72 and a turbine 74. In the usual manner, the turbine 74 is powered by engine exhaust and is drivingly attached to the compressor 72 by a shaft (not shown). The compressor 72 presents a compressor intake 76 and a compressor discharge 78, with the compressor intake 76 communicating with an air intake system (not shown). The compressor 72 receives air from the air intake system (not shown) and discharges compressed air through the compressor discharge 78 and into the intake manifold (not shown) by way of a charge air cooler (not shown), as will be readily appreciated by one of ordinary skill in the art.

The turbine 74 presents a turbine intake 80 and a turbine discharge 82. The turbine intake 80 is fluidly attached to the exhaust manifold 68. Thus, exhaust from the engine 26 travels through manifold runners 84 of the exhaust manifold 68, through a manifold outlet 86, and is received by the turbine intake 80. As will be discussed in greater detail below, the exhaust discharged from the turbine 74 is treated by an exhaust treatment assembly 88. While the illustrated engine 26 includes a turbocharger 70, it is also within the scope of the present invention to have the engine 26 be naturally aspirated. Furthermore, it is also within the ambit of the present invention to have the tractor 20 powered by a gasoline engine instead of the illustrated diesel engine 26. Again, the diesel engine 26 is drivingly attached to the track assemblies 34, 35 by way of a transmission (not shown) to power the tractor 20, as will be readily appreciated by one of ordinary skill in the art upon review of this disclosure.

With attention now to FIGS. 2-4, the vehicle cooling assembly 28 serves to cool the engine 26 and other components of the tractor 20. As will be discussed further, the vehicle cooling assembly 28 also houses part of the exhaust assembly 30 (in particular, the exhaust treatment assembly 88). The vehicle cooling assembly 28 broadly includes an enclosure 90 and a powered fan 92 operable to vent the enclosure 90. The enclosure 90 is substantially rigid and presents spaced apart front and rear margins 94, 96, spaced apart top and bottom margins 98, 100, and spaced apart side margins 102, 103. The enclosure 90 includes a pair of side walls 104, 105 that each include a frame 106, 107 and a door 108, 109 pivotally mounted on each of the frames 106, 107, respectively. The illustrated side walls 104, 105 present respective ones of the side margins 102, 103 and extend substantially parallel to one another to interconnect multiple heat exchangers 110, 112, 114 of the enclosure 90.

As shown in FIG. 2, the heat exchangers 110, 112, 114 fluidly communicate with engine components through coolant lines and serve to release heat from the same, as will be readily appreciated by one of ordinary skill in the art upon review of this disclosure. In particular, the heat exchangers 110, 112, 114 may comprise, for example, generally conventional heat exchanger elements, such as an engine radiator, an oil cooler, a charge air cooler, a fuel cooler, and/or an air conditioner condenser. The depicted heat exchangers 110, 112, 114 each extend generally laterally to interconnect the side walls 104, 105 and cooperatively serve to present an air inlet 116 of the enclosure 90. Additional details of heat exchangers suitable for use with the vehicle cooling assembly 28 of the present invention are described in detail in U.S. patent application Ser. No. 12/504,521 (the '521 application), entitled Agricultural Vehicle Emission Aftertreatment Device Utilizing Heat Exchanger Ventilation, filed Jul. 16, 2009, and having the same assignee of record as the present application. The '521 application is hereby incorporated by reference in its entirety, to the extent not inconsistent with the present disclosure.

Turning now to FIGS. 3-7, the enclosure 90 also includes a fan shroud assembly 118 that presents a air outlet opening 120. In the illustrated embodiment, the fan shroud assembly 118 is disposed rearwardly to present the rear margin 96 of the enclosure 90. Furthermore, the front and rear margins 94, 96, the top and bottom margins 98, 100, and the side margins 102, 103 are each respectively spaced apart to present an airflow area 122, with the airflow area 122 being substantially enclosed by the margins 94, 96, 98, 100, 102, 103. The airflow inlet 116 and the airflow outlet 120 permit fluid communication between the airflow area 122 and the environment. While the illustrated enclosure 90 of the present invention is preferred, it is also within the ambit of the present invention to include an alternatively configured enclosure (not shown).

For example, an alternative enclosure could include a different number or configuration of heat exchangers for cooling the tractor 20 (e.g., an enclosure could include a heat exchanger in place of a side wall to present a corresponding side margin). Details of an alternative embodiment of an enclosure with multiple heat exchangers, suitable for use with the vehicle cooling assembly 28 of the present invention, are disclosed in U.S. Pat. No. 7,128,178 (the '178 patent), entitled Vehicle Cooling Radiator Arrangement, issued Oct. 31, 2006. The '178 patent is hereby incorporated by reference in its entirety, to the extent not inconsistent with the present disclosure.

The enclosure 90 is preferably mounted to the forward end 36 of the chassis frame 32 adjacent the front end 52 and in front of the engine 26. In this way, the enclosure 90 extends generally upwardly adjacent the front end 52 of the tractor 20 receive an uninterrupted stream of environmental air (i.e., the air stream received is not interrupted by other components of the tractor 20, except for the corresponding vents 58, 60 of the hood 50) when the tractor 20 is stationary or traveling over the ground. The enclosure 90 is also disposed so that the air inlet 116 is adjacent the front vent 58 and the top vent 60. Thus, the uninterrupted stream of environmental air can flow into the airflow area 122 by passing through either or both the front vent 58 and/or the top vent 60 and into the corresponding air inlet 116.

The air outlet 120 is disposed adjacent the side vents 62 so that heated air within the airflow area 122 can be drawn by the powered fan 92 through the air outlet 120 and then blown outwardly through the side vents 62 in a rearward direction and away from a rear end of the engine compartment 56. In this manner, the illustrated positioning of the enclosure 90 within the hood 50 and the configuration of the vents 58, 60, 62 adjacent the enclosure 90 permits environmental air to pass through the airflow area 122 and be heated by the vehicle cooling assembly 28, with the heated air then being discharged rearwardly so that the heated air is restricted from re-entering the airflow area 122. Thus, the vehicle cooling assembly 28 is operable to efficiently cool components of the tractor 20.

The powered fan 92 is generally conventional and includes a plurality of circumferentially spaced fan blades 124. The powered fan 92 is preferably mounted on a drive shaft 126 that is drivingly attached to the diesel engine 26 and is powered thereby. However, it is also within the scope of the present invention to have the fan 92 powered by another motor, such as a hydraulic motor (not shown). In the usual manner, the powered fan 92 is positioned to rotate within the air outlet opening 120. In the illustrated embodiment, the fan 92 rotates to draw air through the air inlet 116 and through the airflow area 122, with heated air being drawn through the air outlet opening 120.

It is noted, however, that the principles of the present invention are equally applicable when a fan is positioned in an air inlet of the enclosure 90 and is thus alternatively configured to push air through the airflow area 122 and then through openings presented by heat exchangers. In addition, while the fan 92 is preferably positioned adjacent the rear margin 86 of the enclosure 90, it is also within the ambit of the present invention to dispose the powered fan 92 adjacent another margin of the enclosure 90, as will be readily appreciated by one of ordinary skill in the art upon review of this disclosure.

Returning now to FIGS. 2-4, the exhaust assembly 30 receives engine exhaust from the engine 26, treats the exhaust, and discharges the treated exhaust out to the environment. The exhaust assembly 30 broadly includes an exhaust intake line 128, the exhaust treatment assembly 88, an exhaust discharge line 130, and an exhaust muffler 132. The exhaust muffler 132 comprises a conventional cylindrical muffler and includes a muffler intake 134 disposed adjacent a lower end of the muffler 132 and a muffler discharge 136 disposed adjacent an upper end of the muffler 132. However, the exhaust muffler 132 could be alternatively configured and constructed to provide a suitable exhaust noise reduction consistent with the scope of the present invention. The illustrated exhaust muffler 132 is supported on the chassis frame 32 by mounting the lower end of the muffler 132 on the tower 38. The exhaust muffler 132 could be alternatively disposed or supported on the chassis frame 32 without departing from the teachings of the present invention.

As noted above, the exhaust treatment assembly 88 is disposed within the enclosure 90. As shown particularly in FIG. 4, the exhaust treatment assembly 88 is positioned within the airflow area 122, such that the exhaust treatment assembly 88 is cooled by the passage of the stream of air moving through the enclosure 90. The illustrated exhaust treatment assembly 88 comprises a diesel particulate filter (DPF) that is operable to treat diesel engine exhaust by removing particulate matter. However, the principles of the present invention are also applicable where the exhaust treatment assembly 88 includes another type of treatment device, such as a selective catalytic reduction (SCR) filter for removing $NO_X$, an exhaust noise muffler, or a combination of treatment elements. While the illustrated exhaust assembly 30 preferably includes a single exhaust treatment assembly 88, it is also within the ambit of the present invention to include multiple exhaust treatment devices. Additional structural details of the illustrated exhaust treatment assembly 88 are disclosed in the '521 application, noted and incorporated by specific reference above.

The exhaust treatment assembly 88 is operable for conducting a regeneration operation, whereby an air-fuel mixture within the exhaust treatment assembly 88 is combusted for regeneration of the DPF element. As will be readily appreciated by one of ordinary skill in the art upon review of this disclosure, regeneration involves the removal of excessive amounts of particulate matter in the DPF element. The combustion process during a regeneration cycle is conducted at a high temperatures (during which exhaust gas in the exhaust lines 128, 130 can reach approximately 650° C.), as will be understood by one of ordinary skill in the art. Due in part to the high temperatures of the regeneration cycle, the exhaust treatment assembly 88 is advantageously disposed within the airflow area 122 of the enclosure 90 for cooling purposes, as discussed in detail in the '521 application, noted and incorporated by specific reference above.

The exhaust lines 128, 130, including the exhaust intake line 128 and the exhaust discharge line 130, are generally conventional in construction, and fluidly connect the diesel engine 26, the exhaust treatment assembly 88, and the exhaust muffler 132 as described below. Portions of each of the exhaust lines 128, 130 include an insulating sleeve 138, 140, respectively, therearound, as will be readily understood by one of ordinary skill in the art. Due in part to the high temperature of the exhaust gases passing through the exhaust lines 128, 130, the insulating sleeves 138, 140 may help to protect other components within the engine compartment 56 from damage that may otherwise occur upon contact with the lines 128, 130. In one embodiment, a radial thickness dimension of the insulating sleeves 138, 140 is in the range of approximately one quarter inch to one half inch (¼" to ½").

Exhaust intake line 128 is attached at one end to the turbine discharge 82 of the turbocharger 70 and at the other end to an inlet area of the exhaust treatment assembly 88. Thus, the exhaust line 128 receives an untreated exhaust gas flow from the turbocharger 70 (disposed outside of the enclosure 90) and directs the untreated flow to the exhaust treatment assembly 88 (disposed inside of the enclosure 90). Exhaust discharge line 130 is attached at one end to a discharge area of the exhaust treatment assembly 88 and at the other end to the muffler intake 134. Thus, the exhaust line 130 supplies treated engine exhaust gas from the exhaust treatment assembly 88 (disposed inside of the enclosure 90) to the exhaust muffler 132 (disposed outside of the enclosure 90). Therefore, with specific reference to FIGS. 3-5, it can be seen that both of the exhaust lines 128, 130 pass through the fan shroud assembly 118, as will be discussed in detail below.

Each of the exhaust lines 128, 130 further includes flexible "bellows" sections 142, 144, 146 that interconnect adjoining portions of the exhaust lines 128, 130, as is generally conventional, to provide for relative movement within the lines 128, 130 that may be introduced by engine vibrations and/or high temperature exhaust gas flow through the lines 128, 130. In particular, the exhaust intake line 128 includes two bellows sections 142, 144 that are arranged in series and spaced from the fan shroud assembly 118 (see FIG. 3). The exhaust discharge line 130 includes a single bellows section 146 disposed adjacent the fan shroud assembly 118 (see FIG. 10), as will be discussed in more detail below.

With reference now to FIGS. 3-10, the fan shroud assembly 118 will be described in more detail. The illustrated fan shroud assembly 118 broadly includes a shroud body 148, a pair of insulated connection assemblies 150, 152 operably sealingly secured thereto, and a sealing element 153 disposed about the outer periphery of the shroud body 148.

As described briefly above, the fan shroud assembly 118 is configured to define the rear outlet margin 96 of the enclosure 90. The shroud body 148 is disposed adjacent the powered fan 92 and presents a radially inner converging portion 154 and a radially outer base portion 156. The converging portion 154 protrudes axially relative to the fan 92 and presents a radially inner margin 158 that defines a generally axially oriented central opening 160 disposed adjacent the fan 92. In the illustrated embodiment, the radially inner margin 158 is substantially continuous and the central opening 160 is generally circular. In one embodiment, the shroud body 148 is formed of a high temperature composite material, although alternative suitable materials and/or composites could be used without departing from the teachings of the present invention.

The base portion 156 defines a pair of generally axially oriented exhaust line receiving passageways 162, 164, each spaced radially from the central opening 160. As shown particularly in FIGS. 5 and 10, the exhaust lines 128, 130 each pass through the passageways 162, 164, respectively, to fluidly communicate exhaust gas from one side of the fan shroud assembly 118 to the other. In more detail, and with specific attention to FIGS. 6, 7, and 10, the base portion 156 of the shroud body 118 includes an axially protruding rim 166, 168 extending around each of the passageways 162, 164, respectively.

As shown specifically in FIG. 6, the shroud body 148 comprises three discrete shroud sections 170, 172, 174 that are secured to one another to cooperatively form the illustrated shroud body 148. Each shroud section 170, 172, 174 presents a radially inner margin portion 158*a*, 158*b*, 158*c*, respectively, to cooperatively form the inner margin 158 of the shroud body 148. Each shroud section 170, 172, 174 also presents a radially outer margin portion 176*a*, 176*b*, 176*c*, respectively, to cooperatively define a radially outer periphery 176 of the shroud body 148. Each shroud section 170, 172, 174 further presents opposed engagement margins 178*a*, 178*b*, 178*c* and 180*a*, 180*b*, 180*c*, respectively, with at least a portion of each engagement margin 178*a*, 178*b*, 178*c* flushly abutting at least a portion of the corresponding engagement margin 180*c*, 180*a*, 180*b* of the adjacent shroud section.

In the illustrated embodiment, each of the shroud sections 170, 172, 174 presents generally axially protruding assembly flanges 182*a*, 182*b*, 182*c* and 184*a*, 184*b*, 184*c*, respectively, each disposed along a corresponding engagement margin 178*a*, 178*b*, 178*c* and 180*a*, 180*b*, 180*c* for securing adjacent sections 170, 172, 174 to one another. A plurality of fasteners comprising bolt-and-nut assemblies 186 pass through respective assembly flanges 182*a*, 182*b*, 182*c* and 184*a*, 184*b*, 184*c* of adjacent shroud sections 170, 172, 174 to secure the sections to one another. It is noted that alternative fasteners (e.g., glue or clamps) could also be used to secure the shroud sections to one another without departing from the teachings of the present invention. In addition, an alternative shroud body may be comprised of more or fewer shroud sections, including the use of a single shroud section, while remaining within the ambit of the present invention.

In a preferred embodiment, each of the passageways 162, 164 is cooperatively defined between adjacent shroud sections 170, 172 and 172, 174. As illustrated in FIG. 6, the shroud section 170 includes a portion 166*a* of the rim 166, the shroud section 172 includes a corresponding portion 166*b* of the rim 166 and a portion 168*a* of the rim 168, and the shroud section 174 includes a corresponding portion 168*b* of the rim 168. Each of the shroud sections 170, 172, 174 includes at least one cutout extending generally inwardly from the engagement margin 178*b*, 178*c*, 180*a*, 180*b* to cooperatively define (along with the corresponding cutout of an adjacent section) the passageways 162, 164.

With specific reference to FIG. 10, an external diameter dimension of the insulation sleeve 140 on the exhaust discharge line 130 relative to an internal diameter dimension of the rim 168 defining the passageway 164 creates an air gap 188 being defined between the exhaust discharge line 130 and the shroud body 148. Thus, direct contact between the exhaust discharge line 130 and the shroud body 148 is prohibited. In one embodiment, a radial distance dimension of the air gap 188 is in the range of approximately one eighth inch to one quarter inch (⅛" to ¼"). As will be readily appreciated by one of ordinary skill in the art upon review of this disclosure, a similar air gap (not shown) is defined between the exhaust intake line 128 and the shroud body 148 at the passageway 162. Thus, direct contact between the exhaust intake line 128 and the shroud body 148 is likewise prohibited.

Referring now to FIGS. 3-6 and 10, the pair of insulated connection assemblies 150, 152 operably secured to the shroud body 148 will be described in more detail. It is initially noted that the insulated connection assemblies 150, 152 are identical in construction, with only insulated connection assembly 152 being depicted in detail in FIG. 10. Therefore, the insulated connection assembly 152 will be described in detail here, with it being readily apparent to one of ordinary skill in the art upon review of this disclosure that the insulated connection assembly 150 shares the same construction details.

The insulated connection assembly 152 generally includes a collar element 190 and lock rings 192, 194. The collar element 190 is generally annular and is configured to radially surround the exhaust lines 128, 130 adjacent the rims 166, 168 of the shroud body 148. The illustrated collar element 190 presents opposite axial margins 196, 198 and a central portion 200 that presents a diameter dimension that is greater than a diameter dimension along the axial margins 196, 198.

The lock ring 192 is disposed externally around the axial margin 196 to secure the axial margin 196 of the collar element 190 to the exhaust line 130. The lock ring 194 is disposed externally around the actual margin 198 to secure the extra margin 198 of the collar element 190 to the rim 168 of the shroud body 148. The collar element 190 is sufficiently deformable such that, while the air gap 188 is maintained between the rim 168 of the shroud body 148 and the exhaust line 130 along the axial margin 198, the axial margin 196 is clamped in direct contact around the exhaust line 130 to form an airtight seal and thereby prevent undesirable recirculation of hot air back into the enclosure 90 (see FIG. 10). With continued reference to FIG. 10, it will be readily appreciated by one of ordinary skill in the art that the enlarged diameter of the central portion 200 provides space for accommodating the bellows 146 of the exhaust line 130 within the collar element 190.

As shown in FIG. 10, the illustrated collar element 190 is preferably formed in a laminated construction including an innermost stainless steel tube 202, an intermediate fiberglass insulating core 204, and an outermost stainless steel foil 206, although alternate constructions may be used without departing from the teachings of the present invention. The laminated construction of the preferred embodiment of the collar element 190 allows the steel layers 202, 206 to be spot welded together around the insulating core 204 to shield the insulating core 204 from excess heat or undesirable moisture, either or both of which may damage the insulating material.

As shown specifically in FIG. 6, the collar element 190 comprises a pair of generally semicircular collar portions 208, 210, which are secured together by the lock rings 192, 194, in order to facilitate assembly or disassembly of the collar element 190 about the exhaust line 130. The depicted collar portions 208, 210 are identical to one another. It is noted that alternative numbers of collar portions, including a single collar portion, may be utilized without departing from the teachings of the present invention.

With reference now to FIGS. 5-9, the sealing element 153 disposed about the outer periphery 176 of the shroud body 148 will be described in more detail. The sealing element 153 extends generally radially outwardly from the outer periphery 176 of the shroud body 148. In a preferred embodiment, the sealing element 153 defines a plurality of generally axially oriented tube receiving passages 212, 214, 216, 218, 220, 222. Each of the tube receiving passages 212, 214, 216, 218, 220, 222 is configured to receive a corresponding tube 224, 226, 228, 230, 232, 234 for fluid communication of material through the fan shroud assembly 118 from outside of the enclosure 90 to inside the enclosure 90, or vice versa (see FIG. 4).

Each of the tube receiving passages 212, 214, 216, 218, 220, 222 generally includes a circular hole 236, 238, 240, 242, 244, 246 and a linear slit 248, 250, 252, 254, 256, 258 extending radially from the hole to an outer periphery of the sealing element 153 such that a respective tube 224, 226, 228, 230, 232, 234 can be laterally positioned therein. In a preferred embodiment, the sealing element 153 comprises a sufficiently resiliently deformable material (e.g., foam or a foam-like material) such that the sealing element 153 can be resiliently deformed about a respective tube 224, 226, 228, 230, 232, 234 to receive the same therearound.

As shown specifically in FIG. 6, the sealing element 153 comprises a plurality of sealing element portions 260, 262, 264, 268, 270. In the illustrated embodiment, three of the sealing element portions 260, 262, 264 include a plurality of tube receiving passages 212, 214, 216, 218, 220, 222. It is of course noted that alternative configurations of a sealing element may be utilized without departing from the teachings of the present invention, as will be readily appreciated by one of ordinary skill in the art.

With reference to FIG. 4, the insulation assemblies 150, 152 and the sealing element 153 cooperatively provide airtight seals around the respective exhaust lines 128, 130 and tubes 224, 226, 228, 230, 232, 234 passing through the shroud body 148. In this manner, the cooling air stream flowing through the enclosure 90 (from the air inlet 116 and through the central opening 160 of the shroud body 148 as drawn by the fan 92) does not undesirably recirculate back into the enclosure 90 after exiting therefrom. The cooperative sealing of the fan shroud assembly 118 against corresponding elements of the enclosure 90 provides efficient operation of the vehicle cooling assembly 28, while maintaining necessary passthrough of the exhaust gas and fluids from one side of the fan shroud assembly 118 to the other.

The passage of the exhaust gas and fluids through the shroud body 148 (through the exhaust lines 128, 130 and the tubes 224, 226, 228, 230, 232, 234, respectively) advantageously promotes efficiency of the vehicle cooling assembly 28 while providing compact geometry for the exhaust lines 128, 130 and the tubes 224, 226, 228, 230, 232, 234 to fit within the engine compartment 56 of the tractor 20.

In operation, the diesel engine 26 powers the tractor 20, with exhaust gas generated by the diesel engine 26 flowing through the turbine 74 to power the turbocharger 70. The exhaust gas is then passed, via the exhaust intake line 128, into the exhaust treatment assembly 88 for treatment to reduce pollutants in emissions. Following treatment, the treated exhaust gas is passed, via the exhaust discharge line 130, into the exhaust muffler 132 and out to the environment via the muffler discharge 136. At the same time, the powered fan 92 is rotated by the engine 26 to draw cooling vent air through the air inlet 116, along an air stream through the enclosure 90 (with cooling air flowing across the exhaust treatment assembly 88 disposed within the airflow area 122), and out through the air outlet 120 defined by the central opening 160 in the fan shroud assembly 118.

As will be readily appreciated by one of ordinary skill in the art, the exhaust treatment assembly 88 requires periodic maintenance to remove excessive amount of particulate matter. The particulate matter is removed from the exhaust tube assembly 88 by activating a regeneration head (not shown) of the exhaust treatment assembly 88. In particular, a mixture of fuel and air is supplied to the regeneration head and combusted within the exhaust treatment assembly 88 along with the particulate matter. Residual ash from combustion is occasionally removed from the exhaust treatment assembly 88. During such a regeneration cycle, the air gap 188 prohibits direct contact between the exhaust lines 128, 130 and the shroud body 148, thereby protecting the shroud body 148 from the extreme temperatures of the exhaust lines 128, 130.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A fan shroud assembly for use with a cooling assembly of an engine-powered vehicle, wherein the vehicle has a high-temperature engine exhaust line presenting an outer dimension, said fan shroud assembly comprising:

a shroud body including a radially inner converging portion and a radially outer base portion, said converging portion protruding axially and presenting a radially inner margin defining a generally axially oriented central opening configured to be disposed adjacent a fan, said base portion defining a generally axially oriented exhaust line receiving passageway spaced radially from the central opening and configured to receive the exhaust line therethrough, said exhaust line receiving passageway being configured so as to present an inner dimension that is greater than the outer dimension of the exhaust line, thereby presenting an air gap between the shroud body and the exhaust line prohibiting direct contact therebetween; and an insulated connection assembly disposed adjacent the exhaust line receiving passageway and configured to provide a sealing connection between the exhaust line and the shroud body, said connection assembly presenting an elongated body configured to span the air gap and sealingly engage the shroud body and the exhaust line adjacent opposite ends thereof.

2. The fan shroud assembly as claimed in claim 1, said base portion of the shroud body including an axially protruding rim extending around the exhaust line receiving passageway.

3. The fan shroud assembly as claimed in claim 2, said connection assembly being operably secured to the rim about the circumference thereof.

4. The fan shroud assembly as claimed in claim 3, said connection assembly including a collar and a lock ring.

5. The fan shroud assembly as claimed in claim 4, said collar including a pair of generally semicircular collar portions to define a split collar, said connection assembly including a lock ring disposed at each axial margin of the split collar to secure the collar to the rim of the shroud body and to the exhaust line passing therethrough.

6. The fan shroud assembly as claimed in claim 1, said shroud body including a plurality of shroud sections secured to one another to cooperatively form a sectioned shroud body.

7. The fan shroud assembly as claimed in claim 6, each shroud section presenting a radially inner margin, a radially outer margin, and opposed engagement margins, wherein the engagement margins extend between the inner margin and the outer margin, at least a portion of each engagement margin flushly abutting at least a portion of a corresponding engagement margin of the adjacent shroud section.

8. The fan shroud assembly as claimed in claim 7, each shroud section presenting axially protruding assembly flanges disposed at least partially along the engagement margins for securing adjacent sections to one another; and a plurality of fasteners passing through the assembly flanges of adjacent shroud sections to secure the sections to one another.

9. The fan shroud assembly as claimed in claim 8, said passageway being cooperatively defined between adjacent shroud sections.

10. The fan shroud assembly as claimed in claim 9, each shroud section including at least one cutout extending inwardly from an engagement margin, said passageway being defined by corresponding cutouts of adjacent sections.

11. The fan shroud assembly as claimed in claim 1; and a sealing element disposed adjacent a radially outer periphery of the base portion of the shroud body and extending radially outwardly therefrom, said sealing element defining a plurality of generally axially oriented tube receiving passages extending therethrough for receiving tubes, with each passage configured to receive a tube for fluid communication of material through the fan shroud assembly from one side thereof to the other.

12. The fan shroud assembly as claimed in claim 11, each of said passages including a generally circular hole and a slit extending radially from the hole to an outer periphery of the seal such that a tube can be laterally positioned therein.

13. The fan shroud assembly as claimed in claim 12, said sealing element being formed of a resiliently deformable foam or foam-like material.

14. A self-propelled, low-emission vehicle having an engine compartment in which an internal combustion engine operable to power the vehicle is disposed, said vehicle comprising:

a vehicle cooling assembly disposed within the engine compartment and including an enclosure and a powered fan operable to vent the enclosure, with the engine being disposed outside of the enclosure, said enclosure presenting an air inlet and an air outlet to define an airflow area extending therebetween and including at least one heat exchanger operable to discharge heat produced by the vehicle, said powered fan being rotatable about an axis, disposed along one of the air inlet or the air outlet, and operable to direct a stream of air along a path between the air inlet and the air outlet;

an engine exhaust assembly operable to carry engine exhaust gas away from the engine and out to the environment, said engine exhaust assembly including an exhaust treatment device disposed within the enclosure and at least partly within the airflow area to remove heat therefrom, said engine exhaust assembly including intake and discharge exhaust lines leading to and from the exhaust treatment device, respectively; and a fan shroud assembly defining a margin of the enclosure and including a shroud body that presents a radially inner converging portion and a radially outer base portion, said converging portion protruding axially and presenting a radially inner margin defining a generally central opening disposed adjacent the fan, said base portion defining a pair of generally axially oriented passageways spaced radially from the central opening, each of said passageways receiving a respective one of the exhaust lines therethrough and being oversized relative to the respective exhaust line so as to present an air gap between the shroud body and the respective exhaust line to prohibit direct contact therebetween, said fan shroud assembly including an insulated connection assembly disposed adjacent each passageway to provide sealing connection between the respective exhaust line and the shroud body.

15. The self-propelled, low-emission vehicle as claimed in claim 14, said base portion of the shroud body including an axially protruding rim extending around each of the exhaust line receiving passageways, each of said connection assemblies being operably secured to a respective one of the rims about the circumference thereof.

16. The self-propelled, low-emission vehicle as claimed in claim 15, each of said connection assemblies including a collar and a lock ring, each of said collars including a pair of generally semicircular collar portions to define a split collar, each of said connection assemblies including a lock ring disposed at each axial margin of the split collar to secure the collar to the rim of the shroud body and to the exhaust line passing therethrough.

17. The self-propelled, low-emission vehicle as claimed in claim 14, said shroud body including a plurality of shroud sections secured to one another to cooperatively form a sectioned shroud body.

18. The self-propelled, low-emission vehicle as claimed in claim 17, each shroud section presenting a radially inner margin, a radially outer margin, and opposed engagement margins, wherein the engagement margins extend between the inner margin and the outer margin, at least a portion of each engagement margin flushly abutting at least a portion of a corresponding engagement margin of the adjacent shroud section.

19. The self-propelled, low-emission vehicle as claimed in claim 18, each shroud section presenting axially protruding assembly flanges disposed at least partially along the engagement margins for securing adjacent sections to one another; and a plurality of fasteners passing through the assembly flanges of adjacent shroud sections to secure the sections to one another.

20. The self-propelled, low-emission vehicle as claimed in claim 19, each of said pair of passageways being cooperatively defined between adjacent shroud sections.

21. The self-propelled, low-emission vehicle as claimed in claim 14; and a sealing element disposed adjacent a radially outer periphery of the base portion of the shroud body and extending radially outwardly therefrom, said sealing element defining a plurality of generally axially oriented tube receiving passages extending therethrough, with each passage receiving a tube for fluid communication of material through the fan shroud assembly from inside of the vehicle cooling assembly enclosure to outside of the vehicle cooling assembly enclosure.

22. The self-propelled, low-emission vehicle as claimed in claim 21, said sealing element being formed of a resiliently deformable foam or foam-like material.

* * * * *